US006508678B1

(12) United States Patent
Yang

(10) Patent No.: US 6,508,678 B1
(45) Date of Patent: Jan. 21, 2003

(54) ELECTRICAL CONNECTOR ASSEMBLY

(75) Inventor: Sheng-Ho Yang, Taipei Hsien (TW)

(73) Assignee: Advanced Connecteck Inc., Taipei Hsien (TW)

( * ) Notice: Subject to any disclaimer, the term of this patent is extended or adjusted under 35 U.S.C. 154(b) by 64 days.

(21) Appl. No.: 09/653,129

(22) Filed: Aug. 31, 2000

(51) Int. Cl.[7] ..... H01R 13/64
(52) U.S. Cl. ..... 439/677; 439/607
(58) Field of Search ..... 439/607, 610, 439/676, 677, 680, 682, 101, 108, 924.1

(56) References Cited

U.S. PATENT DOCUMENTS

| | | | | | |
|---|---|---|---|---|---|
| 3,710,197 | A | * | 1/1973 | Olds et al. | 317/118 |
| 5,046,960 | A | * | 9/1991 | Fedder | 439/108 |
| 5,051,099 | A | * | 9/1991 | Pickles et al. | 439/108 |
| 5,634,819 | A | * | 6/1997 | Pan et al. | 439/637 |
| 5,647,765 | A | * | 7/1997 | Haas et al. | 439/609 |
| 5,651,685 | A | * | 7/1997 | Brinkman et al. | 439/79 |
| 6,041,498 | A | * | 3/2000 | Hillbish et al. | 29/883 |
| 6,171,125 | B1 | * | 1/2001 | Kirkendall | 439/218 |
| 6,261,129 | B1 | * | 7/2001 | Kusagaya | 439/677 |
| 6,280,209 | B1 | * | 8/2001 | Bassler et al. | 439/101 |
| 6,322,395 | B1 | * | 11/2001 | Nishio et al. | 439/607 |
| 6,386,918 | B1 | * | 5/2002 | Zheng et al. | 439/607 |

FOREIGN PATENT DOCUMENTS

| | | | | |
|---|---|---|---|---|
| GB | 1029090 | * | 5/1966 | 439/677 |

* cited by examiner

*Primary Examiner*—Tulsidas Patel
*Assistant Examiner*—Thanh-Tam Le
(74) *Attorney, Agent, or Firm*—Merchant & Gould P.C.

(57) ABSTRACT

An electrical connector assembly includes a plug having a first mating portion defined by a multi-sided first confining wall, and a receptacle having a second mating portion defined by a multi-sided second confining wall. Each of the first and second confining walls has opposite first and second sides, a pair of opposite third sides respectively connected to two opposite ends of the first side, a pair of fourth sides respectively connected to two opposite ends of the second sides, and a pair of fifth sides each extending between and interconnecting one of the third sides and one of the fourth sides. The first side is longer than the second side. The width between the third sides is greater than that between the fourth sides. The fifth sides are angled away from each other while extending from the fourth sides to the third sides.

5 Claims, 9 Drawing Sheets

ELECTRICAL CONNECTOR ASSEMBLY

BACKGROUND OF THE INVENTION

1. Field of the Invention

This invention relates to an electrical connector assembly, more particularly to a USB type electrical connector assembly.

2. Description of the Related Art

FIG. 1 illustrates a conventional USB (Universal Serial Bus Connector) electrical connector assembly that serves as a medium for data transmission in a computer. The assembly includes a receptacle 1 with a complementary plug 2. The receptacle 1 includes a receptacle housing 12 having a receptacle mating portion 122 formed with a substantially rectangular opening 121 for receiving the plug 2, a receptacle terminal seat 11 disposed in the receptacle housing 12, and a plurality of receptacle terminals 111 mounted on the receptacle terminal seat 11 and having ends adapted to be-connected to a printed circuit board 13. The plug 2 includes a plug housing and a plurality of plug terminals (not shown) mounted in the plug housing. The plug housing has a plug mating portion 21 adapted to mate with the receptacle mating portion 122 and having a cable connecting end 22 adapted to be connected to a cable 23.

The cable 23 normally has two opposite ends provided with the same plugs 2 that respectively serve as data input and output connectors. As such, there is a tendency to plug a wrong one of the plugs 2 into the receptacle 1 of a printed circuit board when using the cable 23 to connect an electrical device to the printed circuit board, thereby hindering data transmission between the electrical device and the printed circuit board.

SUMMARY OF THE INVENTION

Therefore, the object of the present invention is to provide an electrical connector assembly that is capable of overcoming the aforementioned drawback.

According to the present invention, an electrical connector assembly comprises a plug that includes a plug housing having a first mating portion, and a plurality of plug terminals mounted inside the plug housing, the first mating portion being defined by a multi-sided first confining wall; and a receptacle that includes a receptacle housing having a second mating portion to mate with the first mating portion, and a plurality of receptacle terminals mounted inside the receptacle housing, the second mating portion being defined by a multi-sided second confining wall, each of the first and second confining walls having opposite first and second sides, a pair of opposite third sides respectively connected to two opposite ends of the first side, a pair of fourth sides respectively connected to two opposite ends of the second sides, and a pair of fifth sides each extending between and interconnecting one of the third sides and one of the fourth sides, the first side being longer than the second side, the width between the third sides being greater than that between the fourth sides, the fifth sides being angled away from each other while extending from the fourth sides to the third sides.

BRIEF DESCRIPTION OF THE DRAWINGS

In drawings which illustrate embodiments of the invention.

DETAILED DESCRIPTION OF THE PREFERRED EMBODIMENTS

Figure 1:
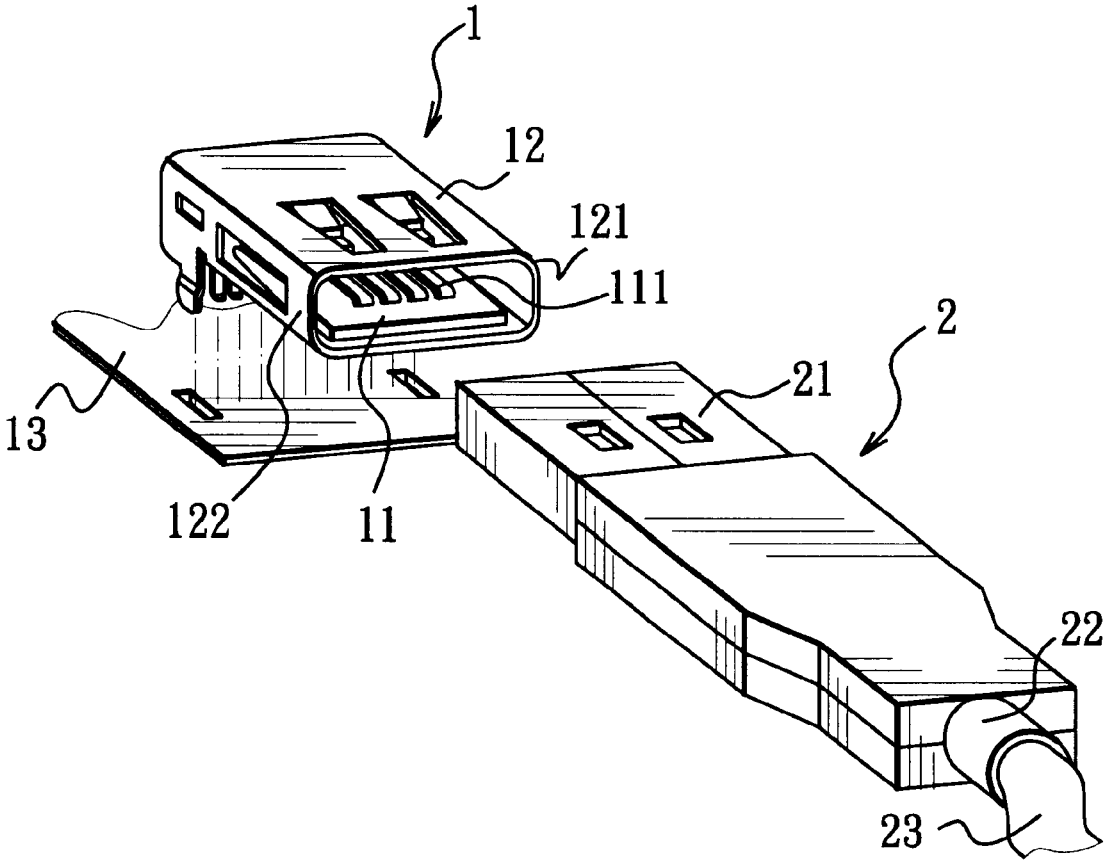
F I G. 1 PRIOR ART
FIG. 1 is an exploded perspective view of a conventional electrical connector assembly adapted to be connected to a printed circuit board.
Figure 2:
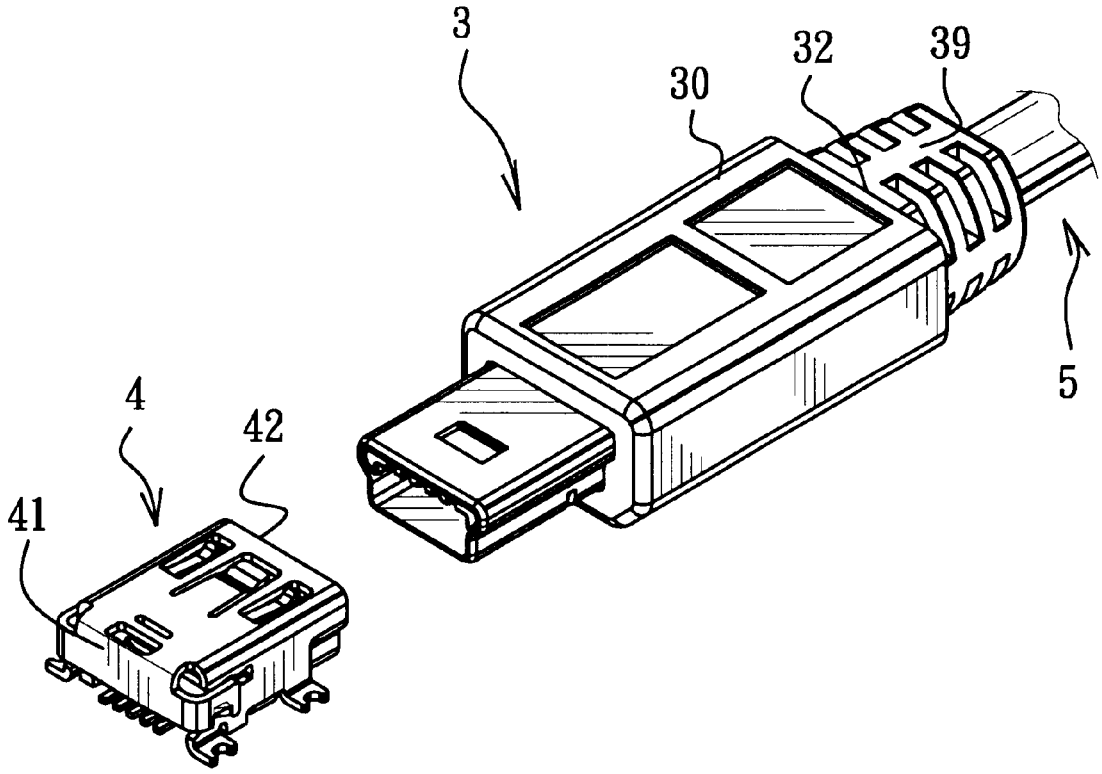
FIG. 2 is an exploded perspective view of an electrical connector assembly embodying this invention.

FIG. 2 illustrates an electrical connector assembly embodying this invention. The electrical connector assembly includes a receptacle 4 with a complementary plug 3.

Figure 3:
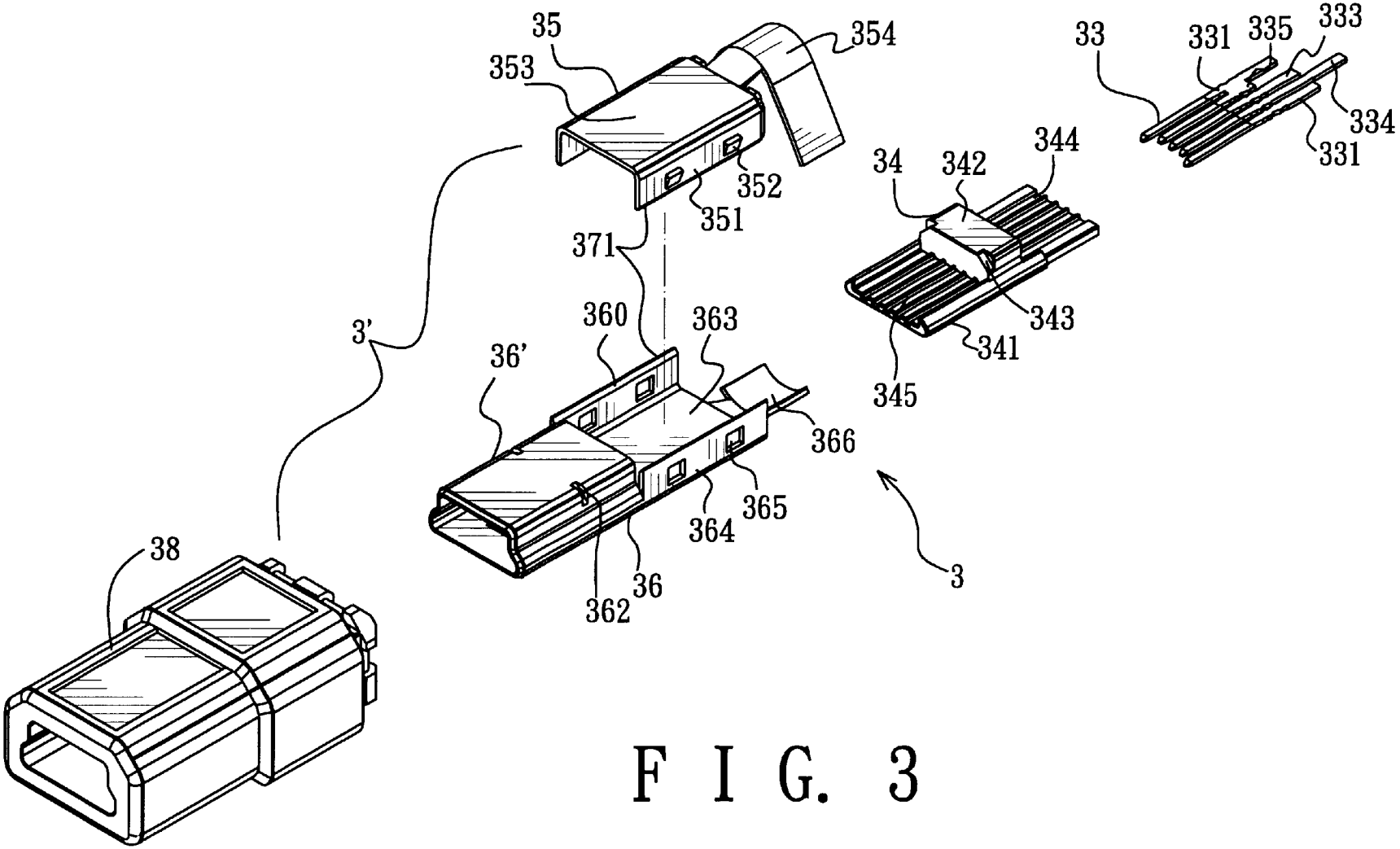
FIG. 3 is an exploded perspective view of a plug of the electrical connector assembly of FIG. 2.
Figure 4:
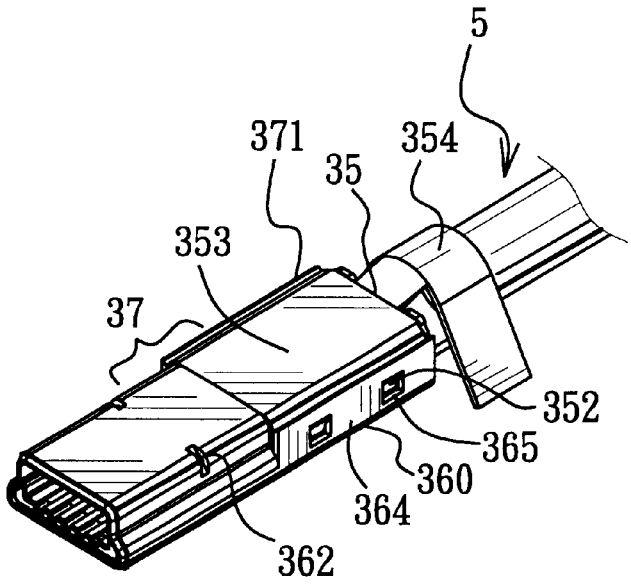
FIG. 4 is a fragmentary perspective view of the plug of FIG. 3.
Figure 5:
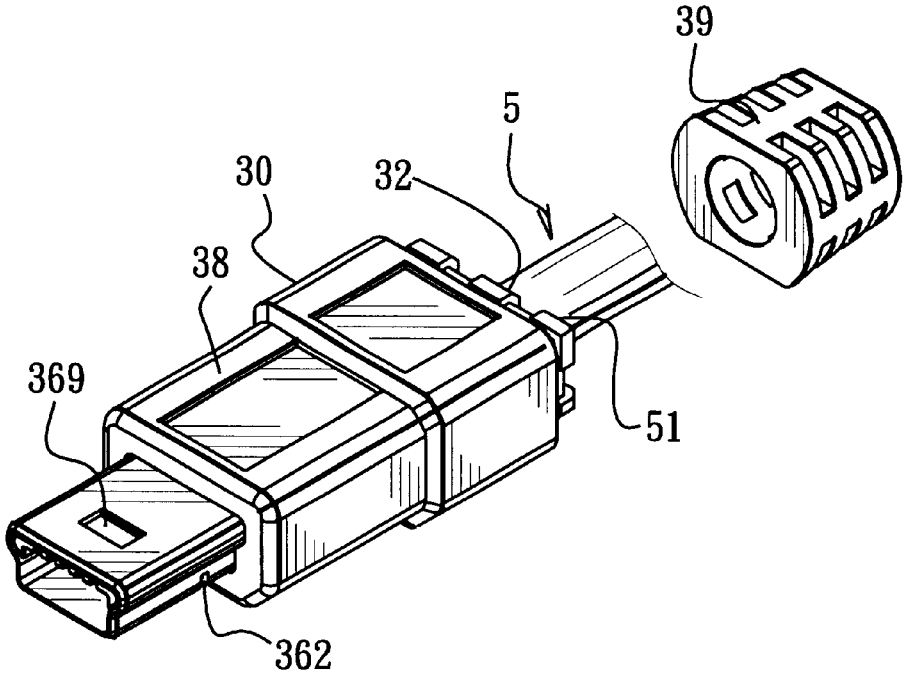
FIG. 5 is a partly exploded perspective view of the plug of FIG. 3.

Referring now to FIGS. 3 to 5, in combination with FIG. 3, the plug 3 includes a plug housing 30 adapted to be connected to a cable 5 at a rear end 32 thereof and having an insulative outer shell 38 and a metal inner shell 37 extending into the outer shell 38, and a plurality of plug terminals 33 mounted in the plug housing 30. The inner shell 37 includes a substantially rectangular supporting portion 371 disposed in the outer shell 38, and a hollow first mating portion 36 defined by a multi-sided first confining wall 36' and projecting from the supporting portion 371 and out of a front end of the outer shell 38. The supporting portion 371 includes a U-shaped base piece. 360 having a flat bight portion 363 and two opposite arms 364 which project from two opposite sides of the bight portion 363 in directions substantially perpendicular to the bight portion 363 and which are formed with through-holes 365, and an inverted U-shaped cover piece 35 coupled with the base piece 360 and having a flat bight portion 353 parallel to the bight portion 363 of the base piece 360 and two opposite arms 351 which project from two opposite sides of the bight portion 353 toward the arms 364 of the base piece 360 and which are formed with tongues 352 that respectively and detachably engage the through-holes 365 when the base piece 360 and the cover piece 35 are coupled together. An arc-shaped plate 366 projects from a rear end of the bight portion 363 to support the cable 5. A positioning tape 354 is secured to a rear end of the cover piece 35 adjacent to the arc-shaped plate 366 for winding on the cable 5 and the arc-shaped plate 366 so as to firmly fix the cable 5 on the arc-shaped plate 366. A pair of opposite positioning tongues 362 project inwardly from the first confining wall 36'. A locking opening 369 is formed in the first confining wall 36'.

The plug terminals 33 are mounted on a plug terminal seat 34 which includes a base part 341 formed with a plurality of terminal passageways 344 for receiving the plug terminals 33 and having a contact portion 345 which projects into the first mating portion 36, and a positioning block 342 projecting from the base part 341, crossing the terminal passageways 344, and having a plurality of grooves aligned with the passageways 344 to confine the plug terminals 33. A pair of positioning recesses 343 are formed in two opposite sides of the positioning block 342 to engage the positioning tongues 362 when the plug terminal seat 34 is disposed in the inner shell 37. An elastic sleeve 39 is sleeved on a connecting end 51 of the cable 5, and is connected to the plug housing 30 for protecting the cable 5 from being bent.

Figure 6:
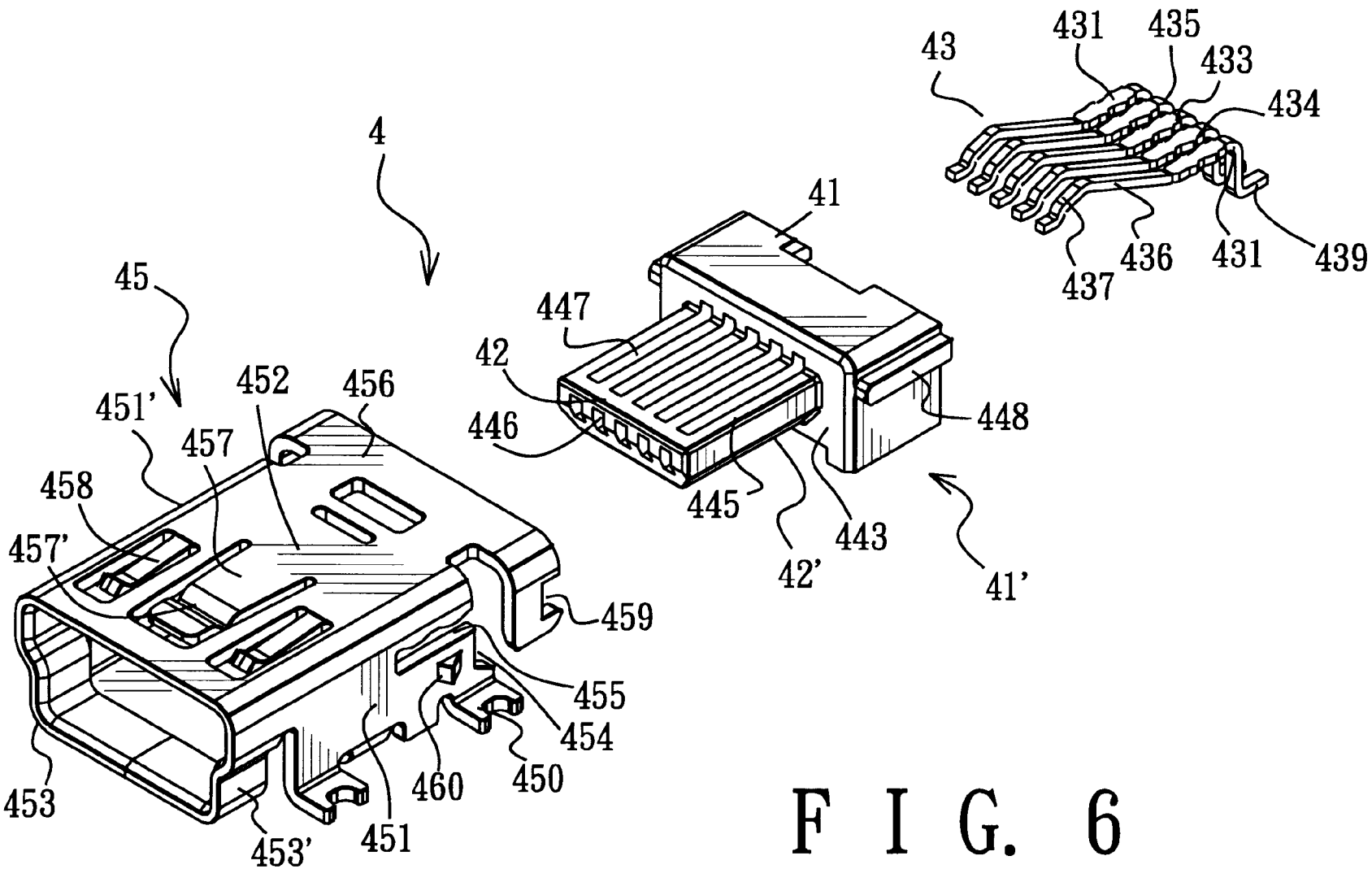
FIG. 6 is an exploded perspective view of a receptacle of the electrical connector assembly of FIG. 2.
Figure 7:
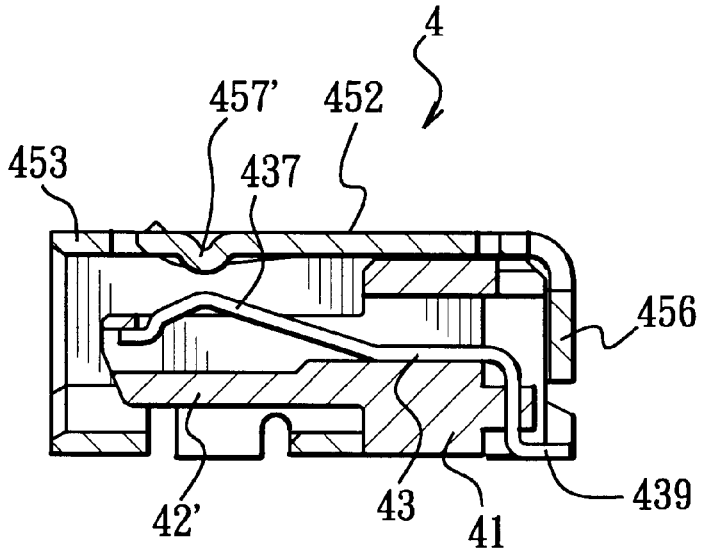
FIG. 7 is a cross-sectional side view of a mating portion of the receptacle of FIG. 6.

Referring now to FIGS. 6 and 7, in combination with FIGS. 2 to 5, the receptacle 4 includes a metal receptacle housing 45 adapted to be mounted on a printed circuit board (not shown) and having a substantially U-shaped supporting portion 451' and a second mating portion 453 defined by a multi-sided second confining wall 453' and projecting from a front end of the supporting portion 451', a receptacle terminal seat 41' mounted on the supporting portion 451', and a plurality of receptacle terminals 43 mounted on the receptacle terminal seat 41'. The supporting portion 451' of the receptacle housing 45 has a bight part 452 and two opposite arms 451 projecting from two opposite sides of the bight part 452 in directions substantially perpendicular to the bight part 452. A cover plate 456 projects from a rear end 454 of the supporting portion 451', and has two opposite legs formed with locking recesses 459. A pair of lugs 450 project from one end of each arm 451 of the supporting portion 451' of the receptacle housing 45 for engaging the printed circuit board. A pair of elongated slots 455 are formed in the arms 451, and open at the rear end 454 of the supporting portion 451'. A pair of tongues 460 project outwardly from the arms 451 between the elongated slot 455 and the lugs 450. The bight part 452 of the supporting portion 451' is punched or is stamped to form a main spring arm 457 and a pair of secondary spring arms 458 thereon. The main spring arm 457 has a front end formed with a bent section 457'.

The receptacle terminal seat 41' includes a rectangular positioning body 41 and a base part 42' projecting from a front face 443 of the positioning body 41 and having a contact portion 42 extending into the second mating portion 453 to mate with the contact portion 345 of the base part 341 of the plug terminal seat 34. A plurality of receptacle terminal passageways 446 are formed in the base part 42' for receiving the receptacle terminals 43. The base part 42' has a side wall 445 defining one side of each receptacle terminal passageway 446 and formed with a plurality of openings 447 that are respectively aligned with and spatially communicated with the receptacle terminal passageways 446. A pair of protrusions 448 respectively project from two opposite sides of the positioning body 41 to engage the elongated slots 455 in the arms 451 of the supporting portion 451' when the assembly of the receptacle terminal seat 41 and the receptacle terminals 43 is disposed in the receptacle housing 45. Each receptacle terminal 43 has a spring arm 436 disposed in one of the receptacle terminal passageways 446 and having a front end formed with a bent portion 437 that protrudes through the respective opening 447 in the side wall 445 of the base part 42', and an L-shaped solder tail 439 extending from the spring arm 436 through the positioning body 41 and adapted to be soldered to the printed circuit board (not shown). The legs of the cover plate. 456 are bent at an angle of 900 to permit the locking recesses 459 to engage the tongues 460 at the arms 451 of the supporting portion 451' after the assembly of the receptacle terminal seat 41 and the receptacle terminals 43 is disposed in the receptacle housing 45.

Figure 9:
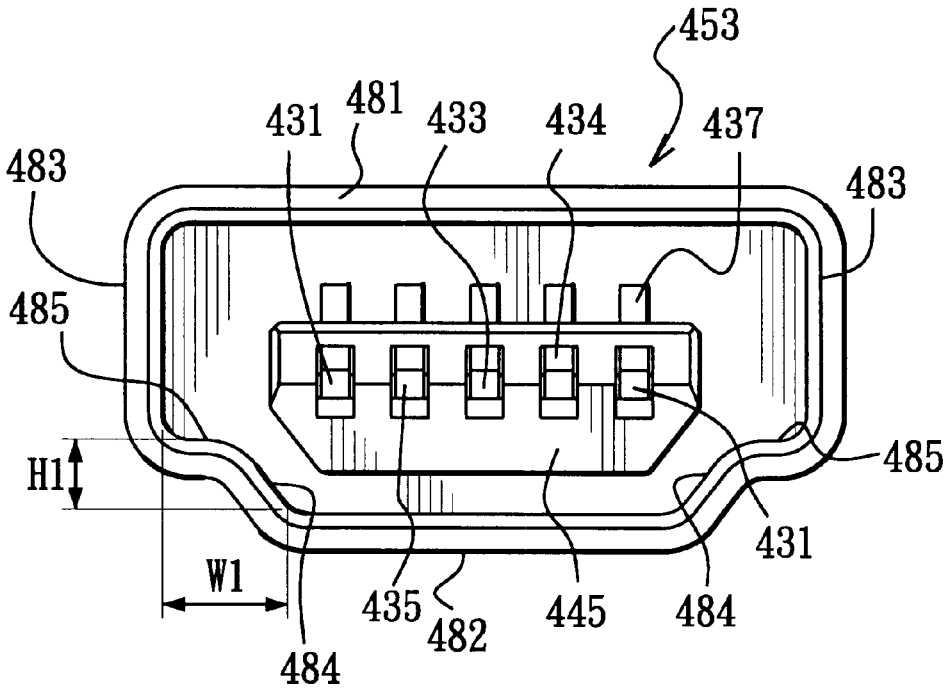
FIG. 9 is a front view of the receptacle of FIG. 6.
Figure 10:
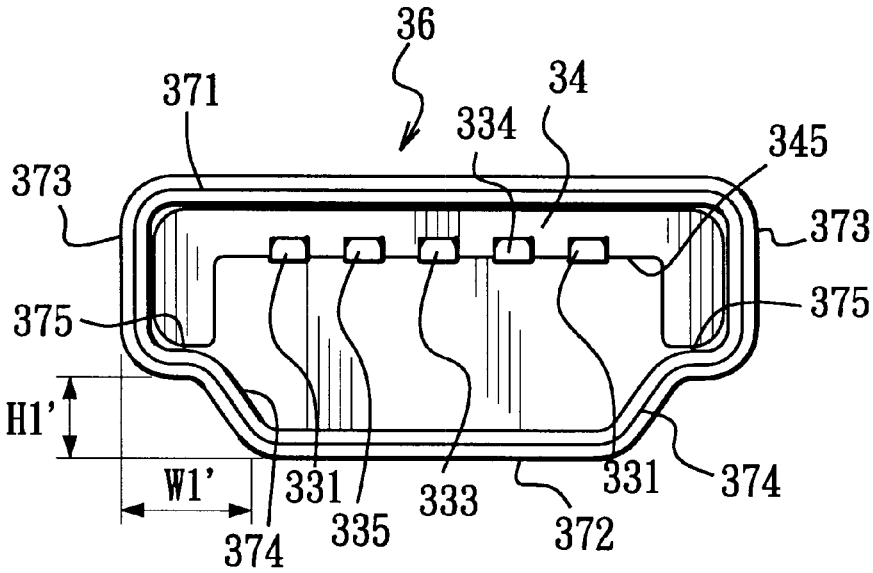
FIG. 10 is a front view of the plug of FIG. 3.

Referring now to FIGS. 9 and 10, in combination with FIGS. 3 and 6, each of the first and second confining walls 36', 453' has opposite first and second sides 371, 372' (481, 482), a pair of opposite third sides 373 (483) respectively connected to two opposite ends of the first side 371 (481), a pair of fourth sides 374 (484) respectively connected to two opposite ends of the second sides 372 (482), and a pair of fifth sides 375 (485) each extending between and interconnecting one of the third sides 373 (483) and one of the fourth sides 374 (484). The first side 371 (481) is longer than the second side 372 (482). The width between the third sides 373 (483) is greater than that between the fourth sides 374 (484). The fifth sides 375 (485) are angled away from each other while extending from the fourth sides 374 (484) to the third sides 373 (483) The first and second sides 371, 372 (481, 482) are substantially parallel. The third sides 373 (483) are substantially perpendicular to the first side 371 (481). The fourth sides 374 (484) extend obliquely and respectively from the opposite ends of the second side 372 (482). The fifth sides 375, (485) are respectively and substantially perpendicular to the third sides 373 (483). The shortest distance (indicated as reference mark H1 shown in FIG. 9 or H1' in FIG. 10) from one of, two opposite ends of each third side 373 (483), that is distal from the first side 371 (481), to a plane defined by the second side 372 (482) is smaller than the distance (indicated as reference mark W1 shown in FIG. 9 or W1' in FIG. 10) from one of the opposite ends of the second side 372 (482), that is adjacent to that third side 373 (483), to a plane defined by that third side 373 (483). The locking opening 369 is formed at the first side 371 of the first confining wall 36'.

Figure 8:
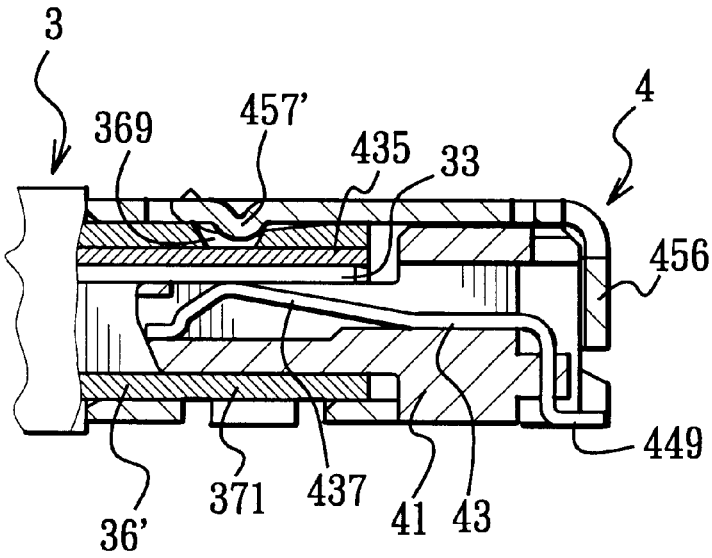
FIG. 8 is a cross-sectional side view to illustrate mating of the receptacle of FIG. 6 and the plug of FIG. 3.

Referring now to FIG. 8, in combination with FIGS. 3 and 7, the locking opening 369 engages the bent section 457' of the main spring arm 457 of the bight part 452, and each plug terminal 33 abuts against the bent portion 437 of the respective receptacle terminal 43 when the plug 3 is plugged into the receptacle 4.

Figure 11:
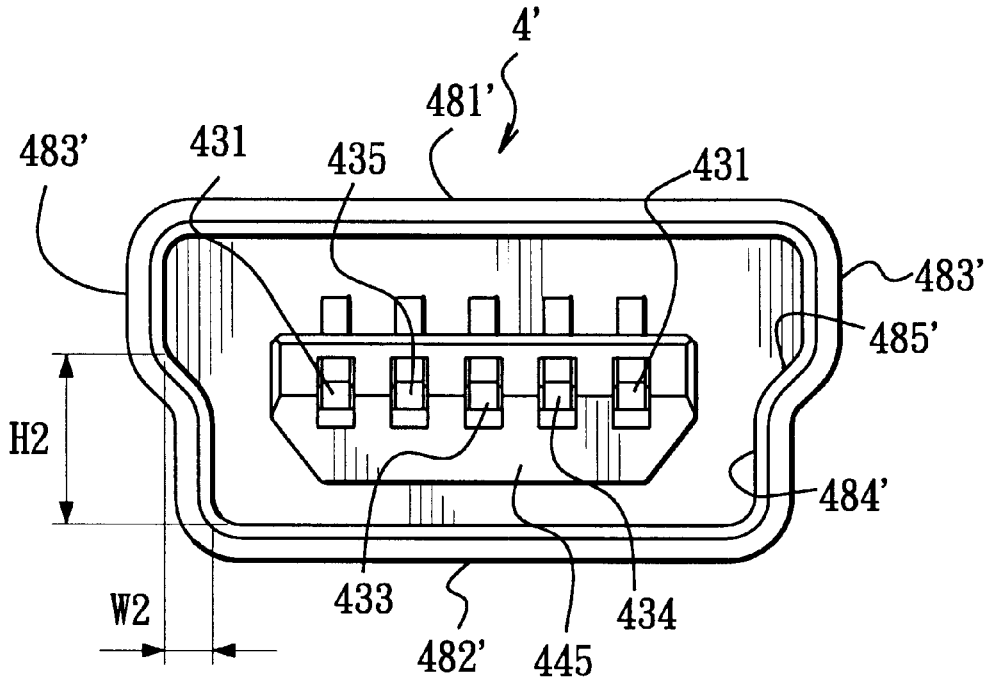
FIG. 11 is a front view to illustrate a modified receptacle of FIG. 6.
Figure 12:
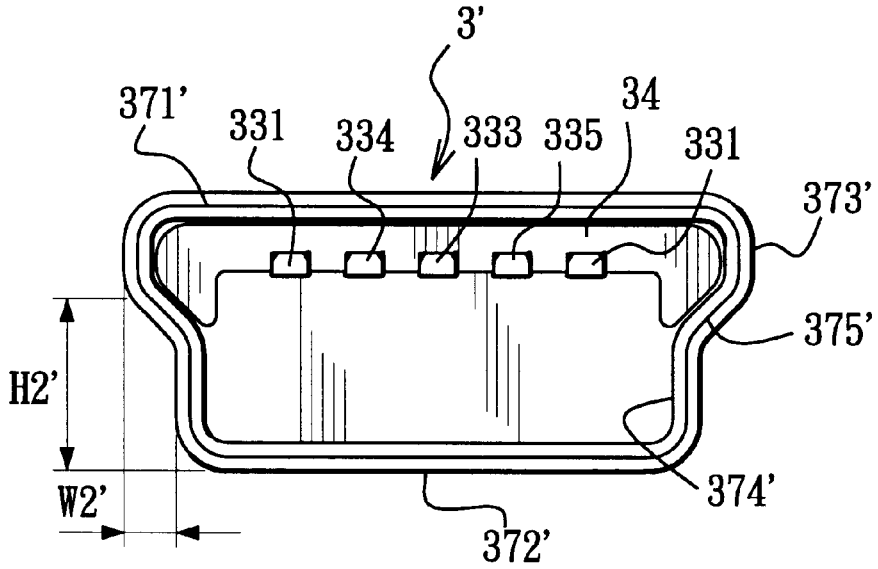
FIG. 12 is a front view to illustrate a modified plug of FIG. 3.

FIGS. 11 and 12 respectively illustrate a modified receptacle 4' and a modified plug 3' which are similar to the previous receptacle 4 and the previous plug 3 except that the fourth sides 374' (484') are substantially perpendicular to the second side 372' (482'), that each fifth side 375' (485') is oblique relative to the respective third side 373' (483') and the respective fourth side 374' (484'), and that the shortest distance (indicated as reference mark H2 shown in FIG. 11 or H2' in FIG. 12) from one of two opposite ends of each third side 373' (483'), that is distal from the first side 371' (481') to the plane defined by the second side 372' (482') is greater than the distance (indicated as reference mark W2 shown in FIG. 11 or W2' in FIG. 12) from an adjacent one of the opposite ends of the second side 372' (482') to the plane defined by that third side 373' (483').

Figure 13:
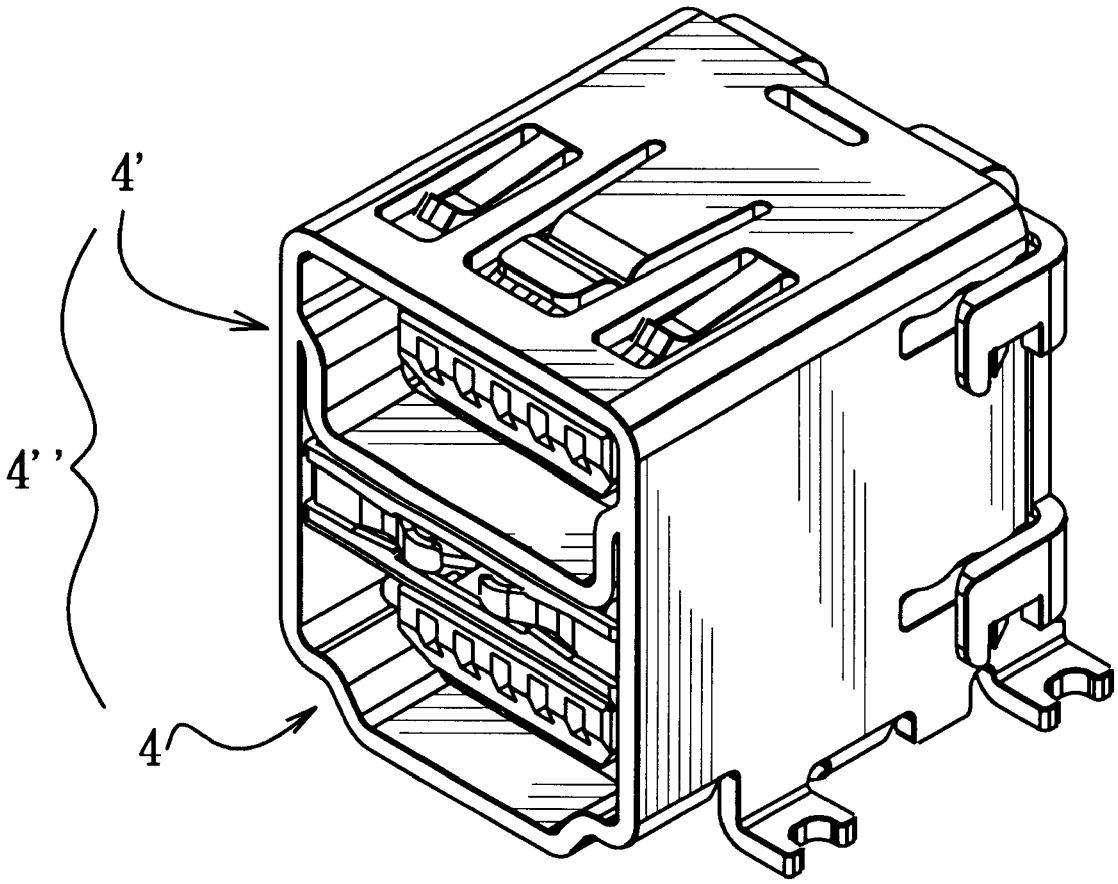
FIG. 13 is a perspective view to illustrate another modified receptacle of FIG. 6.

FIG. 13 illustrates another modified receptacle 4" which is a combination of the previous receptacle 4 and the previous modified receptacle 4' that are stacked one above the other.

Referring now to FIGS. 3 and 6, the plug terminals 33 include spaced apart two first power terminals 331, a first detecting terminal 335 disposed adjacent and integrally formed with one of the power terminals 331, and two spaced apart data terminals 333, 334. The receptacle terminals 43 are spaced apart from each other, and include two second power terminals 431, a second detecting terminal 435 disposed adjacent to one of the power terminals 431, and two data terminals 433, 434. The second detecting terminal 435 is electrically connected to the adjacent one of the second power terminals 431 via the interconnected one of the first power terminals 331 and the first detecting terminal 335 when the plug 3 and the receptacle 4 are coupled together, thereby permitting the printed circuit board to distinguish the type of plug that is connected thereto.

With the invention thus explained, it is apparent that various modifications and variations can be made without departing from the spirit of the present invention. It is therefore intended that the invention be limited only as recited in the appended claims.

I claim:

1. An electrical connector assembly, comprising:

a plug that includes a plug housing having a first mating portion, and a plurality of plug terminals mounted inside said plug housing, said first mating portion being defined by a multi-sided first confining wall; and a receptacle that includes a receptacle housing having a second mating portion to mate with said first mating portion, and a plurality of receptacle terminals mounted inside said receptacle housing, said second mating portion being defined by a multi-sided second confining wall, each of said first and second confining walls having opposite first and second sides, a pair of opposite third sides respectively connected to two opposite ends of said first side, a pair of fourth sides respectively connected to two opposite ends of said second side, and a pair of fifth sides each extending between and interconnecting one of said third sides and one of said fourth sides, said first side being longer than said second side, said first and second sides being longer than each of said third sides, the width between said third sides being greater than that between said fourth sides, said fifth sides being angled away from each other while extending from said fourth sides to said third sides;

wherein said first and second sides are substantially parallel, and said third sides are substantially perpendicular to said first side; and wherein said fourth sides extend obliquely from said second side.

2. The electrical connector assembly of claim 1, wherein said fifth sides are respectively and substantially perpendicular to said third sides.

3. The electrical connector assembly of claim 2, wherein each of said third sides has two opposite ends, the shortest distance from one of said opposite ends of said third side, that is distal from said first side, to a plane defined by said second side being smaller than that from one of said opposite ends of said second side, that is adjacent to said one of said opposite ends of said third side, to a plane defined by said third side.

4. The electrical connector assembly of claim 1, wherein said plug terminals include a first power terminal and a first detecting terminal which is electrically connected to said first power terminal, and said receptacle terminals include a second power terminal and a second detecting terminal which is spaced apart from said second power terminal and which is electrically connected to said second power terminal via said first power terminal and said first detecting terminal when said first and second mating portions are coupled together.

5. The electrical connector assembly of claim 4, wherein said first power terminal and said first detecting terminal are integrally formed and are punched from a metal plate.

* * * * *